US006889851B1

(12) United States Patent
Isola

(10) Patent No.: US 6,889,851 B1
(45) Date of Patent: May 10, 2005

(54) BAR SCREEN

(75) Inventor: Antti Isola, Pietarsaari (FI)

(73) Assignee: Metso Paper, Inc., Helsinki (FI)

( * ) Notice: Subject to any disclaimer, the term of this patent is extended or adjusted under 35 U.S.C. 154(b) by 138 days.

(21) Appl. No.: 10/111,327

(22) PCT Filed: Oct. 26, 2000

(86) PCT No.: PCT/FI00/00929

§ 371 (c)(1),
(2), (4) Date: Aug. 28, 2002

(87) PCT Pub. No.: WO01/31117

PCT Pub. Date: May 3, 2001

(30) Foreign Application Priority Data

Oct. 26, 1999 (FI) ..... 19992305

(51) Int. Cl.[7] ..... B07C 13/05

(52) U.S. Cl. ..... 209/667; 209/666; 209/674; 209/680; 209/687; 209/683

(58) Field of Search ..... 209/666, 667, 209/674, 677, 683, 680, 687

(56) References Cited

U.S. PATENT DOCUMENTS

| | | | | |
|---|---|---|---|---|
| 3,716,144 A | | 2/1973 | Bartlow | |
| 3,752,319 A | | 8/1973 | Richter | |
| 5,011,065 A | * | 4/1991 | Musselmann | 228/170 |
| 5,047,148 A | | 9/1991 | Arai | |
| 5,234,550 A | | 8/1993 | Ekholm et al. | |
| 5,586,662 A | * | 12/1996 | Aikawa | 209/411 |
| 5,605,234 A | * | 2/1997 | Aikawa | 209/411 |
| 5,626,235 A | * | 5/1997 | Aikawa | 209/395 |
| 5,647,128 A | * | 7/1997 | Aikawa | 29/896.62 |
| 6,039,841 A | | 3/2000 | Hernesniemi | |
| 6,669,028 B2 | * | 12/2003 | Aikawa | 209/411 |

FOREIGN PATENT DOCUMENTS

| | | |
|---|---|---|
| FI | U 4031 | 7/1999 |
| WO | 94/19533 | 9/1994 |
| WO | 99/16963 | 4/1999 |

* cited by examiner

*Primary Examiner*—Christopher P. Ellis
*Assistant Examiner*—Jonathan R. Miller
(74) *Attorney, Agent, or Firm*—Young & Thompson

(57) ABSTRACT

A bar screen is primarily intended for use in draining liquid from wood chips and pulp without blocking the bar screen. The area of use is especially a process area, in which cooking and circulation liquid is removed from a pressure vessel when making chemical pulp and paper pulp by continuous method. This type of bar screen is characterized in that behind the filtering gap of the screen bars, there is a flow space in which the liquid flows towards a discharge outlet. By adjusting the flow space, a flow rate of liquid which stops blocking due to accumulation is maintained in the background. The sturdiness of the screen structure is improved by adjustable support taps.

26 Claims, 5 Drawing Sheets

BAR SCREEN

FIELD OF THE INVENTION

The present invention relates to a bar screen primarily used to drain liquid from wood chips and/or pulp. The area of use is then the removal of cooking and circulation liquid in particular from a pressure vessel during the preparation of chemical pulp or paper pulp in a continuous method or batch cooking method.

BACKGROUND OF THE INVENTION

Today, both strength and a low kappa number, i.e. a low lignin content after cooking, are both required of chemically prepared pulp. The requirements are in conflict unless cooking conditions are carefully optimized. These cooking conditions include a correct alkali split, a suitable temperature profile, an adequate amount of liquid, and as small gradients as possible especially in the radial direction of a continuous digester. This requires high circulation and expansion flows.

Because even a partial blocking of expansion and circulation screens causes channelling and disturbed flows in the digester, and often also production losses, it is not always possible to maintain the conditions required for making strong and clean pulp. This is of course a very negative matter, because it causes an increased use of raw material, energy and chemicals, which again increases production costs and environmental loads. Sometimes, blocking also causes the screens to break when the support structures fail.

The screens presently in the market usually comprise a group of bar screens which are often arranged in a manner resembling a chessboard in a desired location on the inner wall of the digester. The screen bars of a bar screen are angular in shape, for instance metal sections machined nearly to the shape of the letter T. The top edge of the T profile then acts as the end face towards plug flow. Screens of this type are disclosed in WO 9419533, for instance. Each installed "chessboard square" comprises a group of screen bars arranged in an upright position and side by side. Between the screen bars, there is a gap through which liquid is sucked. The screen bars are fastened in as parallel manner as possible to a cross member and the screen is equipped with an angle iron frame. In every second square of the chessboard pattern, there is a solid metal plate instead of the bar screen to prevent the formation of a from-screen-to-screen-growing "doughnut" on the jacket of the digester. The doughnut in question slows down the movement of the plug flow in a continuous digester, for instance.

One problem with this known screen construction is that it has a relatively high tendency to block when chips fasten to the gaps. This is due both to the radial wood chip pressure against the screen generated by the gravitational force directed to the chip column and to the radial speed of the liquid outward through the screen. The speed is approximately five times higher than the downward speed of the chips. Typically, the speed of liquid is in the range of 10 to 15 mm/s, whereas the corresponding downward speed of chips is approximately 2 to 3 mm/s. When the compaction rate of the digester is normal, the chips bind each other in place inside the plug flow and partly also on the rim of the plug flow. Small slivers and chip particles follow the partially faster radial liquid flow and fasten to the sharp edges of the screen bars. More chip particles can then settle on such a fastened chip particle and block an even larger area of the screen. A softened chip particle is also easily cut by the sharp edges of the screen bars, which also tends to block the screen. The tendency to blockage described above becomes worse as a bigger area of the open screen surface is blocked, because this generates a bigger load and, at the same time, a bigger danger of blocking in the screen surface still remaining open.

In addition, the backgrounds of the screens are blocked, because flow rates become considerably slower in the backgrounds of the screens and the heavier particles in the liquid start to settle down in the background and finally block the flow area behind the screen.

Due to the positioning of the screen and the manner of blockage, it is very difficult to clean the screen and this should, thus, be avoided at all costs.

Kvaerner Pulping Technologies AB have in their patent SE-B-501243 proposed a horizontal slotted screen as a solution to the blockage problem, the screen being characterized in that the screen bars are horizontal. The screen bars are square or diamond-shaped in cross-section, i.e. sharp cornered. The critical characteristic of this solution is the fact that chip particles lie flat on top of each other like playing cards in the plug flow, and thus, when moving radially along with the lye flow, they easily wedge in the horizontal gaps of the screen or fasten to the sharp corners of the screen bars.

Another and more critical issue is slivers. There is always a large number of slivers among chips. These slivers are approximately the size of matches, sometimes bigger, sometimes smaller. Their diameter can be 1 to 3 mm. A part of these slivers are found sooner or later in the plug flow at the wall of the digester and the screens while the plug flow flows on. A part of the slivers are taken along by the flowing alkaline cooking liquor and they fasten to the sharp corners of the screen bars and/or to other chip particles already fastened to the gaps, thus forming a new fastening surface.

The background volume of the screens is relatively large and causes a decrease in the flow rate and thus deposits.

In other words, prior art screens are difficult to run and many people find that the operation of the bar screens is the Achilles heel of KAMYR digesters.

BRIEF DESCRIPTION OF THE INVENTION

It is an object of the present invention to substantially improve the prior art by reducing the drawbacks related thereto and to this way provide a novel bar screen to drain liquid from wood chips and/or pulp without blockage to the screen and disturbance in the flow.

The invention is based on an idea got during an empirical study that because the greatest pressure difference in a screen is not in the gap but deeper within the plug flow, the back part of the gap can be used as a channel of the vertical flow. If it is not sufficient in size, other parts of the background of the screen are utilised by adjusting the partition. It has also been proven by tests that round shapes provide advantageous friction between the screen and the plug flow. Round shapes also provide superior hydraulic properties.

The bar screen of the invention provides considerable advantages. The screen bars of the bar screen do not have sharp corners to which the cooked wood or pulp could fasten and where it could cut. Because a bar screen of this kind enables a substantial reduction in this kind of fastening, no other material, either, is fastened to the bar screen that might disturb the plug flow and filtering when accumulating.

The bar screen construction of the invention enables continuously high expansion and circulation flows, which substantially improves continuous cooking and its control. Through this, a more even and strong chemical pulp or paper pulp is achieved as well as a more economical and environmentally friendly production process.

The present bar screen provides advantageous flow rates in the pressure vessel to prevent accumulation in the backgrounds of the screens. Total flow rates and volumes are superior in comparison with conventional screen structures.

Using separate support bars to support the bar screen, prevents the collapse of and/or damage to the screen bars. Usually, the bending of 2 to 5 screen bars already increases the load on the remaining screen bars too much. This type of collapse or damage of the screen can be avoided with the present structure.

Selecting different shapes for the cross-profile of the screen bar makes it possible to make the bar screen suitable for different process conditions. This way, a correct type of screen can always be obtained for different chip sizes, different quantities of slivers in the plug flow, etc.

Generating back-pressure vectors to the front parts of the screen bars in the bar screen of the invention, makes the chip particles pressing against the screen to turn on the surface of the screen. This improves the radial flow of the screen out of the plug flow. This way, the hydraulic properties of the screen can also be better utilised.

Enabling the sliding of the chip particles pressed against the screen along the screen bars and their departure from the surface of the screen prevents accumulations in the gaps.

Friction between the screen and the plug flow is also significantly low in the present bar screen.

BRIEF DESCRIPTION OF THE FIGURES

In the following, the invention will be described with reference to the appended drawing which shows a preferred embodiment of the invention.

DETAILED DESCRIPTION OF THE INVENTION

A preferred embodiment of the present bar screen is in the following described with reference to the above-mentioned figures. The bar screen comprises structural parts marked with reference numbers in the figures and corresponding to the reference numbers used in this description.

Figure 1:
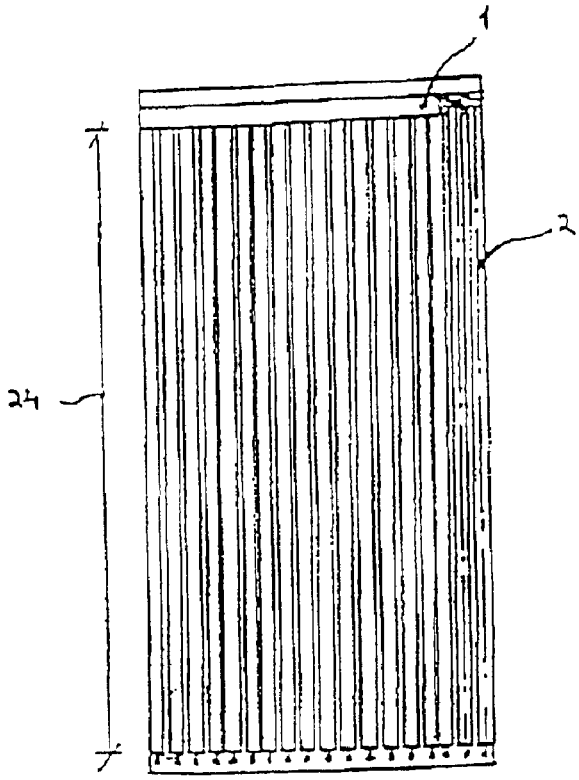
FIG. 1 shows a front view of a bar screen of a preferred embodiment of the invention.
Figure 2:
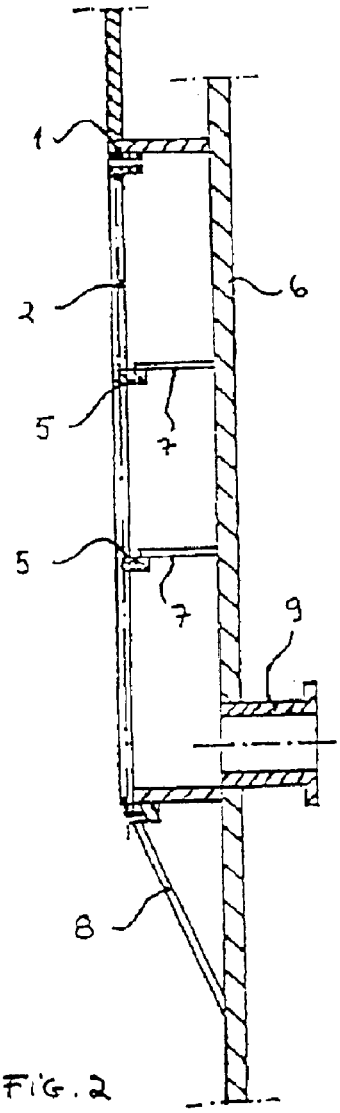
FIG. 2 shows a side view of the bar screen of FIG. 1 arranged to the cover of a pressure vessel.
Figure 3:
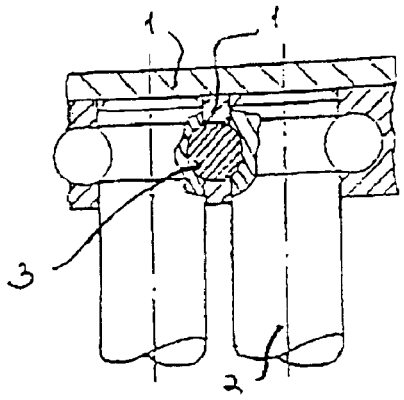
FIG. 3 shows a front view and partial cross-section of a detail of the joining of the top end of the screen bar to the bar screen frame.
Figure 4:
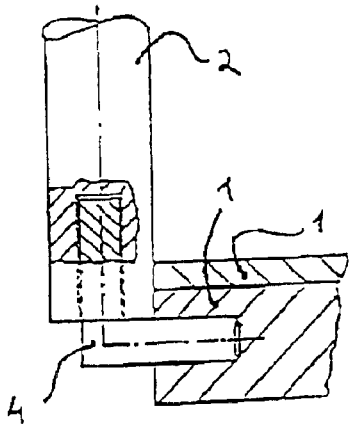
FIG. 4 shows a side view of a detail of the joining of the lower end of the screen bar to the bar screen frame.

FIGS. 1 to 6 show a preferred construction of a bar screen to be arranged in a pressure vessel used in making chemical pulp or paper pulp, the bar screen comprising a frame 1 which is arranged to receive an optional number of screen bars 2 which are symmetrical in cross-profile, e.g. round or elliptic. These screen bars are arranged in the frame substantially parallel and side by side. Thus, the screen bars are at one-top-end connected to the frame by a cottered joint 3 as shown in FIG. 3 or by another corresponding method to avoid welding and the damage it causes to the coating, for instance. Correspondingly, the opposing-lower-ends of the screen bars are, for the same reason, arranged to the frame by a pin mounted joint 4 as shown in FIG. 4. The described connection method also makes it possible to allow the screen bars to rotate around their longitudinal axes, if necessary.

Figure 5:
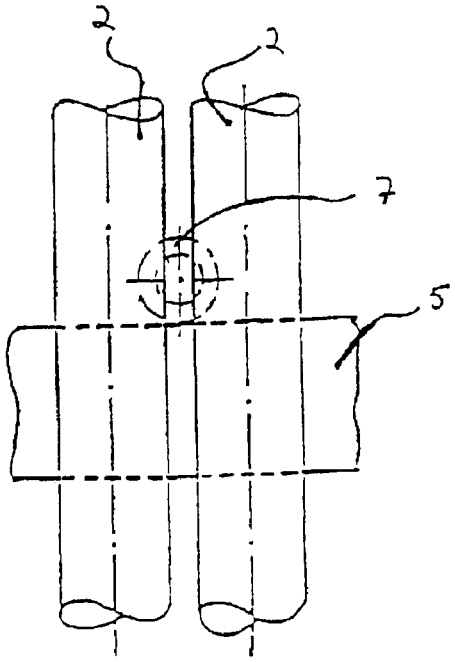
FIG. 5 shows a front view of a detail of a saddle support supporting the screen bar.
Figure 6:
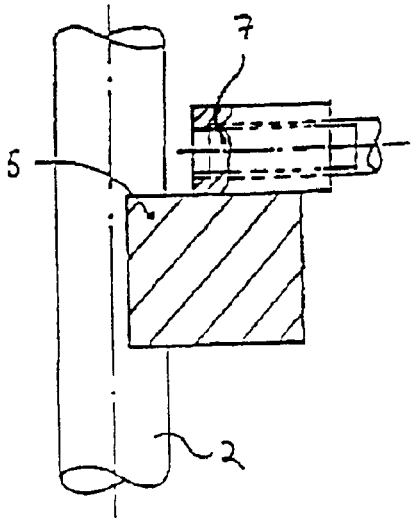
FIG. 6 shows a side view of a detail of the saddle support supporting the screen bar.

Between their extreme ends, the screen bars are preferably supported by one or more saddle supports 5 against a radial chip pressure of the plug flow as shown in FIGS. 5 and 6. The distance of the saddle supports from each other in the longitudinal direction of the screen bar is preferably 300 mm, for instance. This kind of saddle support is preferably arranged to the cover 6 of the pressure vessel by means of a specific support bar 7. These support bars are preferably arranged to be longitudinally adjustable because the cover of the pressure vessel is seldom symmetrically round. The number of support bars used in strength calculations will otherwise not correspond to practice. Adjustable support bars can thus eliminate damage to the bar screen. The support bar is formed of a tapped opening through the saddle support 5 and a master tap in it driven through a filtering gap by means of a special tool and adjusted and locked against the cover of the pressure vessel. Alternatively, the adjustable support bar is formed of a support element fastened to the top part of the saddle support at the filtering gap. It has a tapped opening and a master tap in it, which is adjusted and locked against the cover 6 of the pressure vessel.

To ensure the operation of the bar screen, a separate release strip 8 is arranged to its root end according to FIG. 2. This figure also shows an outlet 9 from the pressure cover.

Figure 7:
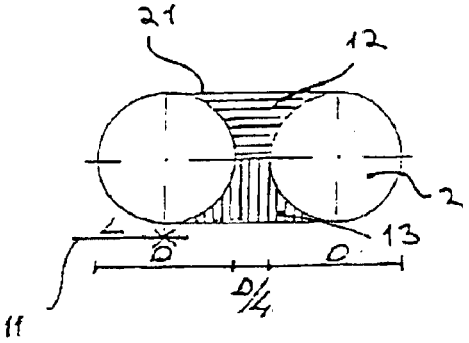
FIG. 7 shows a bar shape of a screen bar with the front and back part of the gaps of adjacent screen bars highlighted by rastering.
Figure 8:
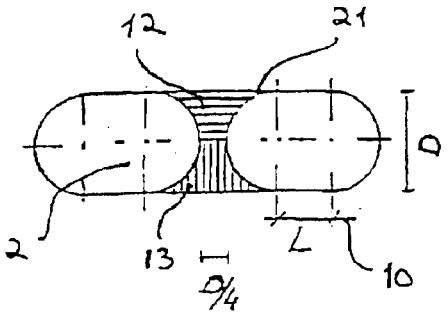
FIG. 8 shows a bar shape of a second embodiment of the screen bar with the front and back part of the gaps of adjacent screen bars highlighted by rastering.
Figure 9:
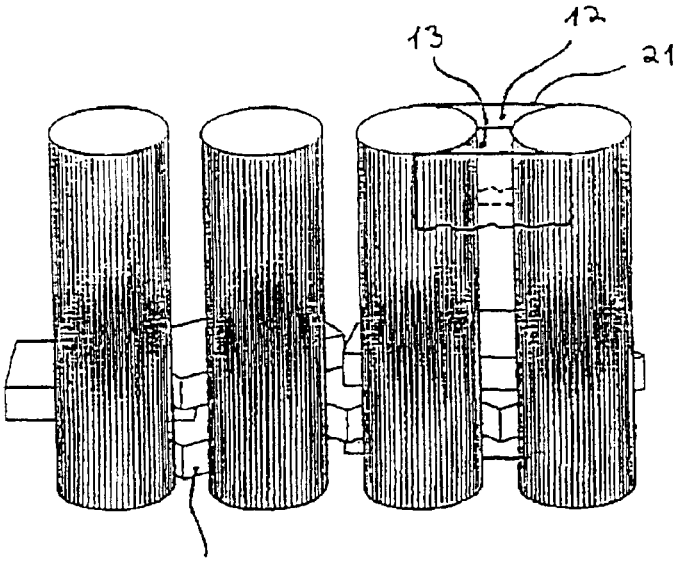
FIG. 9 shows a detail of a filtrating surface of the bar screen and the front and back parts of the gaps.
Figure 10:
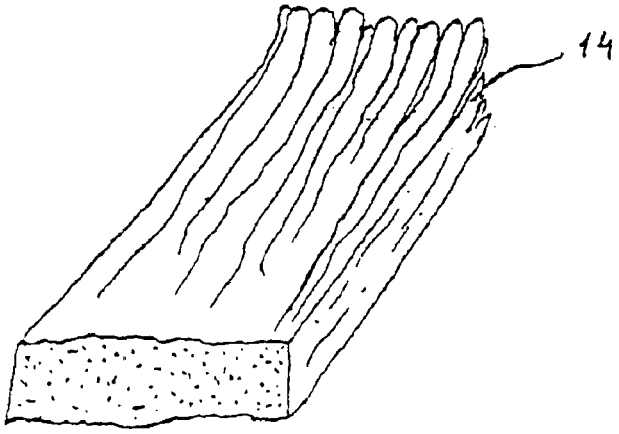
FIG. 10 shows a detail of a chip particle.

In the present embodiment of the bar screen, the cleanliness and, through it, the hydraulic properties of the screen bars are based on their optional shape and on the shape of the gap between adjacent screen bars. According to FIGS. 7 and 8, the end face of the screen bar is optionally S-large end face 10—or P-small end face 11. The gap between adjacent screen bars is in the shape of a narrowing round-edged cone in the front part 12 and in the shape of an widening round-edged cone in the back part 13.

The optional shape of the screen bar is based on the idea that in different process conditions, for instance when processing different wood chip grades, it is advantageous to select a screen bar either from one extreme S or from the other extreme P of the bar selection. Selection criteria of the shape of the screen bar then include the size of the chip 14 used in the process, its compaction rate, the wood-liquid ratio of the pulp being processed, the filtering requirement of the pulp, and the mechanical properties of the apparatus. The end face width L of the screen bar varies between 0.0 and 40.0 mm, and is preferably 0.0 and 20.0 mm.

In the plug flow, the chips settle on top of each other like playing cards thrown on the floor and horizontally in a fully random orientation.

Figure 14:
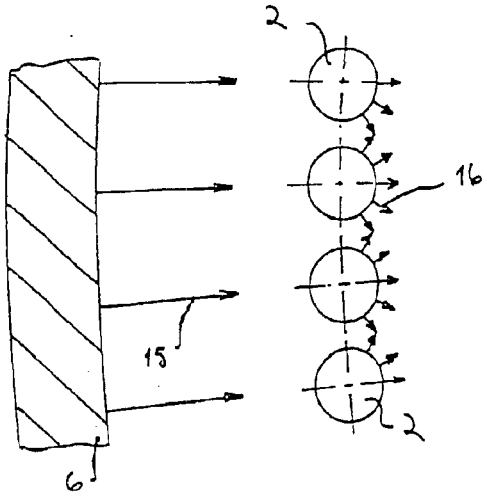
FIG. 14 shows back-pressure vectors generated by the bar screen of the invention.

The gap between the screen bars 2 of the bar screen is a space which has a volume the length of the gap and in this volume, the chips being cooked can settle in different ways. Before settling in a new position in the area of the bar screen, the chips 14 are for instance above the bar screens pressed against the cover 6 of the digester pressure vessel due to the chip pressure, and a back-pressure vector 15 of the cover presses the plug flow and the chips in it in the direction of the pressure vessel/plug flow radius as shown in FIG. 14. When the chip particles and slivers flowing with the plug flow on the rim of the plug flow arrive in the area of the bar screens, the back-pressure vector of the pressure vessel changes into a back-pressure vector 16 generated by the screen bars. When the end face width L of the screen bar is 0.0 mm, for instance, i.e. the bar is round, the back-pressure vectors of the screen bars are directed towards the plug flow, chip particles and slivers, in the direction of the radius of each screen bar in a fan-like manner as shown in FIG. 14. If the width of the end face is more than 0.0 mm and less than 40.0 mm, for instance, the back-pressure vector is in the area of the end face directed into the plug flow in the direction of the radius of the pressure vessel/plug flow. Because the gap between the screen bars is in the shape of a narrowing round-edged cone in the front part 12, i.e. on the side of the plug flow, the back-pressure vector is always radial in the area of the round-shaped rim and directed in a fan-like manner to the plug flow and the chip 14 particles and slivers flowing with it.

Fan-like back-pressure vectors 16 make the chips 14 and slivers turn in plane to settle in the round-edged front part 12 between the screen bars 2. The turning of the chip particles and slivers generates new channels for the alkaline cooking liquor to flow between the particles being cooked into the bar screen.

No fan-like pressure vectors, which would make the chip particles move and thus improve the liquid flow out from the plug flow to the bar screen, are directed to the plug flow due to the basic shape of the bar screen bars constructed according to patent WO 9419533 and also due to the "blind squares" of the screen zone.

The chip particles and slivers turned in different positions in the front part 12 between screen bars 2 provide a chance to examine the conventional "open surface area" concept of the bar screens in a new way.

There is a boundary surface in the space between the screen bars 2, which boundary surface is made up of the outer surfaces of chip particles in different positions and on which boundary surface, filtrating surface 17, the alkaline cooking liquor is separated from the chips being cooked and the plug flow as a whole and removed through the gaps between the bars into circulation.

In conventional flat bar screens, the boundary surface and filtrating surface is nearly planar and the open surface area is calculated as a ratio of the screen gap surface areas to the entire surface area. In those conditions, the open surface area and parting area are almost the same thing, especially when the gap is narrow, 3.0 to 4.0 mm, and the particles being filtered are of the size of chips, for instance.

In this context, it is relevant to emphasise the significance of the shape of the filtrating surface, because liquid is released to open flow in the gap at the filtrating surface 17 and when the shape of the filtrating surface changes, so does the open surface area.

In continuous cooking, chips 14 of coniferous wood, for instance, are on an average 4 to 5 mm thick, 15 to 18 mm wide and 23 to 28 mm long. In these conditions, in a bar screen having L=0.0 mm the diameter of a screen bar 2 is typically 4 to 40 mm, preferably 10 to 20 mm. The gap between screen bars is typically 2 to 15 mm, preferably 3 to 8 mm, wide.

Figure 11:
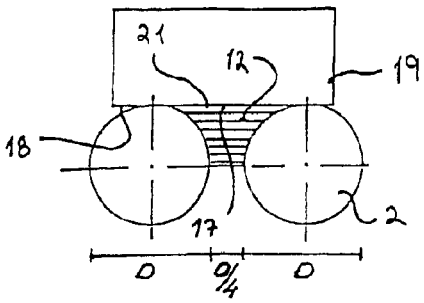
FIGS. 11, 12 and 13 show theoretical position alternatives of a chip particle in the gap of the bar screen.
Figure 13:
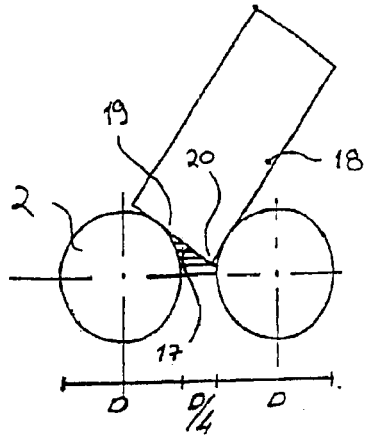
Figure 12:
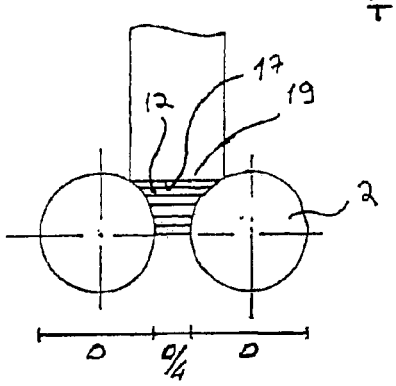

Chips flowing in the plug flow can thus settle against the screen bars 2 most typically in the manner shown in FIGS. 11 to 13. Thus, the chip particles can be positioned as follows:

- the long side 18 of the chip particle is against the screen bars as in FIG. 11
- the short side 19 of the chip particle is against the screen bars as in FIG. 12
- one of the corners 20 of the chip particle is penetrated into the space 12 between the screen bars as in FIG. 13.

It is theoretically possible that all chips settle as shown in FIG. 11. Then the length of the filtrating surface is the same as that of the broader outer side 21 of the narrowing cone-shaped space between adjacent screen bars 2. If the diameter of the screen bar is 16 mm and the gap between the screen bars is 4 mm, the filtrating surface and open surface area of the screen construction is 20 mm/20 mm*100, i.e. 100%.

It is also possible that the chips 14 settle against the screen bars 2 on their short side as in FIG. 12. When the chip is 16 mm wide, for instance, it penetrates partly between the screen bars, whereby the filtrating surface and open surface area becomes with the above-mentioned numerical values 16 mm/20 mm*100, i.e. 80%.

If in theory, the chip particles happen to settle with one corner in the space between the screen bars, the filtrating surface and open surface area becomes with the above-mentioned numerical values 10 mm/20 mm*100, i.e. 50%.

In light of the above-mentioned examination, it can be noted that the open surface area of a conventional bar screen has obtained a depth component through the tridimensionality of the filtrating surface 17. The sum of the profiles of the chip particles orientated towards the outer side of the screen, in the gaps between the screen bars and in different orientations on the entire length of the gap is the surface where liquid is separated from the plug flow on its way to the background of the screen. The profiles of the chip particles form a kind of tridimensional mountain scene whose surface area is relatively large and changes continuously. The tridimensional space formed by the chip particle profiles is based on the geometrical shape of the particles being filtered and, thus, the open surface area is a function of this shape of chip particle profiles. The grade of the chips thus affects the actual, local, open surface area size during filtering.

The chip particles turned in different positions in the space between the screen bars 2 form, while being there and when moving downward with the plug flow, an element-bed-filtering slivers and other particles in addition to the chip particles, endeavouring to flow with the alkaline cooking liquor. The tridimensional filtrating surface of the bed is larger than the two-dimensional one. This way, the outermost chip particles of the plug flow effectively add to the filtering capacity of the bar screen and are a part of an operational entity. Because the chip particles, due to the symmetry of the screen gap, do not encounter any obstacles while sliding along the side of the screen bar, said filtering capacity also does not suddenly decrease.

The screen bars of the bar screen do not have sharp corners to which the cooked chips 14, pulp and slivers can anchor and cut and onto which more material can accumulate to disturb the plug flow and through it, the filtering. The gap between the screen bars is at the narrower end of the narrowing round-edged cone, at the boundary of the front part 12 and the back part 13 arranged to be typically D/4, wherein D=thickness of the screen bar. Most preferably, the gap between the screen bars is D/3.8.

Figure 15:
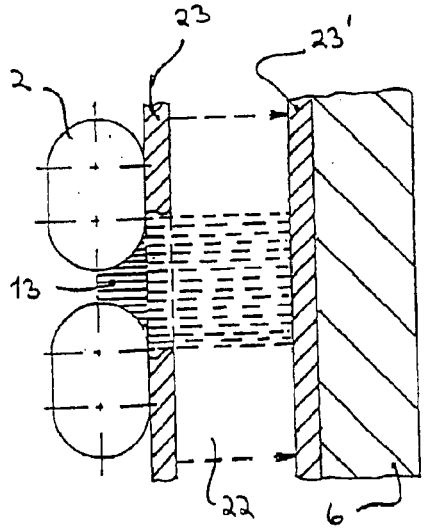
FIG. 15 shows an adjustable wall related to the bar screen.

Because the screen bar 2 is in the area between its opposite ends arranged to be supported by at least one saddle support 5, a flow space 22 in the direction of the plug flow is formed for liquid between the back part 13, shaped like a widening round-edged cone, of the filtering gap between each adjacent screen bar and the cover 6 of the pressure vessel. The flow surface area of such a flow space is sufficient to form a vertical flow in the liquid flowing from the filtering gap to move it at an accelerating rate to the outlet 9 in the cover or to its immediate proximity. The depth of the flow space can be adjusted by a wall 23 according to FIG. 15. If the wall rests against the screen bar, the depth of the flow space is at its lowest. If the wall rests against the cover 6 of the digester pressure vessel, the depth of the flow space is at its deepest. The flow direction of the liquid in the flow space 22 can be with the plug flow or against it depending on whether the outlet is located at the top, bottom or both ends of the screen.

So that the surface area of the flow space 22 would not harmfully decrease at the saddle support 5, a separate space can be formed in it at the filtering gap by machining, for instance. This type of machining work is preferably done by water-cutting. The cross-sectional area of the flow space is also arranged to be so big and increasing in the flow direction of the liquid that a pressure loss created in the flow space and in the direction of the plug flow is smaller than the pressure loss created in the filtering gap between the screen bars 2 and perpendicular to the plug flow.

By adjusting the depth of the back part 13 of the gap shaped like a round-edged widening cone between the screen bars 2 along the entire length 24 of the screen bar, the volume is also adjusted, which controls the flow rate of the lye in said volume—"channel."

The flow rate of the back part 13 volume, "channel", affects the cleanliness of the "channel." A correct rate prevents accumulations in the backgrounds of the bar screens.

To minimise friction, the screen bars 2 are ground to a value which typically varies between Ra=0.6 to 0.8, most preferably Ra=0.3. The screen bars are preferably also electro-polished or coated with a low-friction agent, such as fluoroplastic (PTFE).

The fastening of the lower end of the screen bars is designed so that the chip particle corners and other parts penetrated into the front part 12 shaped like a round-edged narrowing cone between the screen bars can slide unobstructedly out the gap of the bar screen back to the plug flow.

The bar screen can be equipped with a mechanical screen gap cleaner known per se.

The bar screen of the present embodiment works in process conditions as follows. When circulation liquid is sucked out from the plug flow in an absorption tower and continuous digester, the bar screen separates the pre-cooked chips 14, slivers and pulp from the circulation liquid by a combined effect of the narrowing/widening round-edged cone-like gap, resulting from the shape of the screen bars 2, and the chip particles settled in it.

Because the screen bars are non-angular in shape on the side of the plug flow and also either polished or fluoroplastic-coated, for instance, the chip particles outermost in the plug flow or the slivers or corresponding smaller particles flowing with the lye cannot fasten to the sharp corners of the screen bars and thus form fastening points for other particles flowing past.

Figure 16:
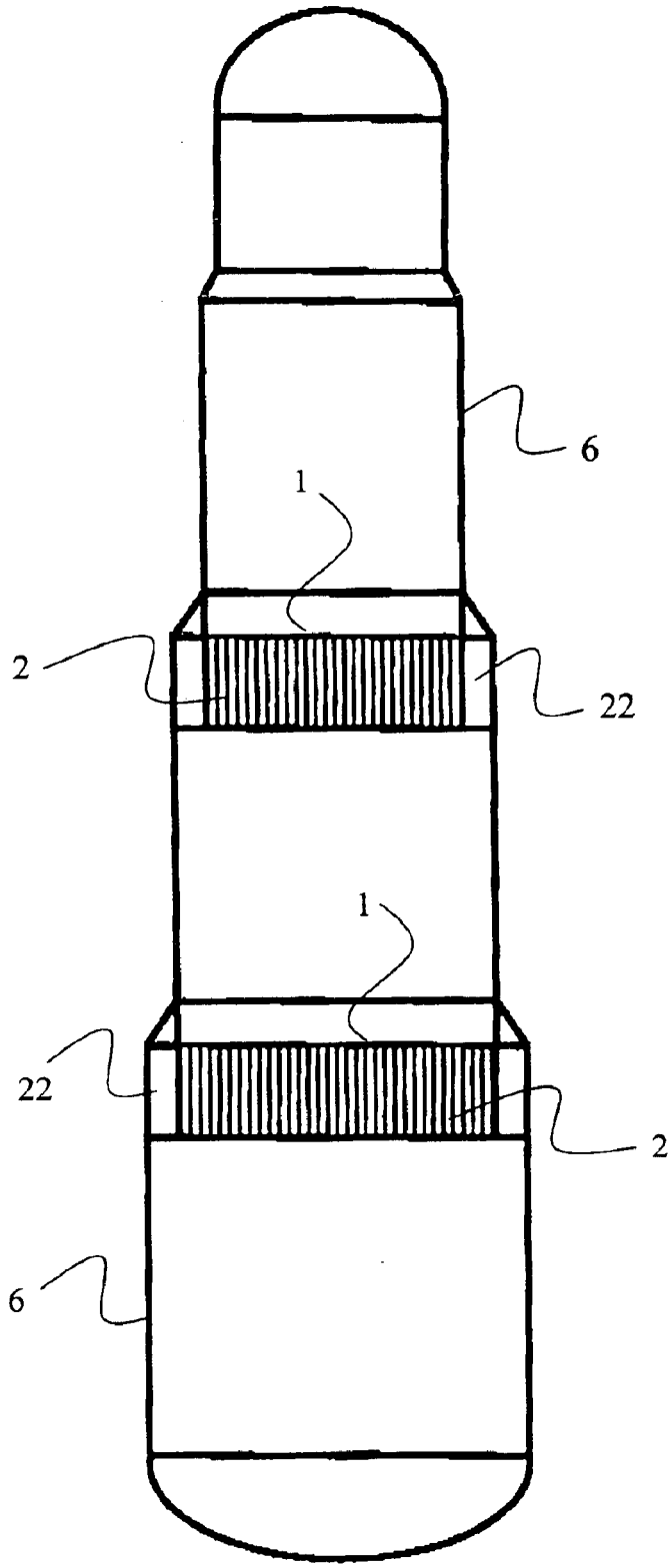
FIG. 16 shows the bar screen of the invention in a device for draining liquid from wood chips and/or pulp.

The low edge of the bar screen is constructed in such a manner that the gap is open at its lower end, and the chip particles flowing downward with the plug flow in the cone-like gap return unobstructedly to the plug flow after having passed the bar screen and done their share in filtering. The bar screen may be used in a device such as illustrated in FIG. 16.

It will be understood that the above description and the related figures are only intended to illustrate the present invention. The invention is thus not restricted to the embodiment disclosed above or specified in the claims, but the many variations and modifications of the invention which are possible within the scope of the inventive idea specified in the appended claims will be obvious to a person skilled in the art.

What is claimed is:

1. A bar screen for draining liquid from chips in a pulp processor, the bar screen comprising:

a frame and plural screen bars fastened substantially parallel to the frame at their opposite ends in such a manner that a filtering gap is formed between adjacent ones of the screen bars, each of the screen bars having essentially parallel end faces having a length of 0–40 mm, the end faces being connected by rounded parts;

the gap between the adjacent ones of the screen bars being divided in two adjacent parts, a front part with a narrowing round-edged cone shape and a back part with a widening round-edged cone shape, the back part providing a channel for a flow of extracted liquid;

a filtrate chamber in fluid communication with the back part for extraction of the liquid therefrom; and a saddle support between opposite ends of the screen bars supporting at least one of the screen bars, wherein at the gap in the saddle support, a space is provided separate from the back part to prevent a decrease in surface area of the filtrate chamber at the saddle support.

2. The bar screen of claim 1, wherein the screen bars are rotatable around their longitudinal axes.

3. The bar screen of claim 1, wherein the screen bars have a surface Ra of 0.6 to 0.8.

4. The bar screen of claim 1, wherein the end faces have a length greater than 0 mm.

5. A bar screen for draining liquid from chips in a pulp processor, the bar screen comprising:

a frame and plural screen bars fastened substantially parallel to the frame at their opposite ends in such a manner that a filtering gap is formed between adjacent ones of the screen bars, each of the screen bars having essentially parallel end faces having a length of 0–40 mm, the end faces being connected by rounded parts;

the gap between the adjacent ones of the screen bars being divided in two adjacent parts, a front part with a narrowing round-edged cone shape and a back part with a widening round-edged cone shape, the back part providing a channel for a flow of extracted liquid; and a wall adjacent to said screen bars, the wall being movable relative to the end faces at the back part so as to define a depth of a flow space for the extracted liquid.

6. The bar screen of claim 5, wherein the screen bars are rotatable around their longitudinal axes.

7. The bar screen of claim 5, wherein the screen bars have a surface Ra of 0.6 to 0.8.

8. The bar screen of claim 5, wherein the end faces have a length of greater than 0 mm.

9. A bar screen for draining liquid from chips in a pulp processor, the bar screen comprising:

a frame and plural screen bars fastened substantially parallel to the frame at their opposite ends in such a manner that a filtering gap is formed between adjacent ones of the screen bars, each of the screen bars having essentially parallel end faces having a length of 0–40 mm, the end faces being connected by rounded parts, the screen bars being rotatable around their longitudinal axes.

10. The bar screen of claim 9, wherein the screen bars have a surface Ra of 0.6 to 0.8.

11. A bar screen for draining liquid from chips in a pulp processor, the bar screen comprising:

a frame and plural screen bars fastened substantially parallel to the frame at their opposite ends in such a manner that a filtering gap is formed between adjacent ones of the screen bars, each of the screen bars having essentially parallel end faces having a length of 0–40 mm, the end faces being connected by rounded parts, the screen bars having a surface Ra of 0.6 to 0.8.

12. The bar screen of claim 11, wherein the screen bars are coated with a fluoroplastic.

13. The bar screen of claim 11, further comprising at least one saddle support between opposite ends of the screen bars.

14. The bar screen of claim 11, wherein the end faces have a length of greater than 0 mm.

15. A bar screen for draining liquid from chips in a pulp processor, the bar screen comprising:

a frame and plural rounded screen bars fastened substantially parallel to the frame at their opposite ends in such a manner that a filtering gap is formed between adjacent ones of the screen bars;

the gap between the adjacent ones of the screen bars being divided in two adjacent parts, a front part with a narrowing round-edged cone shape and a back part with a widening round-edged cone shape, the back part providing a channel for a flow of extracted liquid;

each of the screen bars having a diameter of 4 to 40 mm; and each gap being 2 to 15 mm wide.

16. The bar screen of claim 15, wherein each of the screen bars has a diameter of 10 to 20 mm and each gap is 3 to 8 mm wide.

17. The bar screen of claim 15, wherein each of the screen bars is symmetric.

18. The bar screen of claim 15, wherein each of the screen bars has essentially parallel end faces having a length of 0–40 mm, the end faces being connected by rounded parts.

19. The bar screen of claim 18, wherein the end faces have a length greater than zero.

20. The bar screen of claim 15, wherein the gap is from D/4 to D/3.8, where D is a diameter of the screen bars.

21. The bar screen of claim 15, wherein a joint of an end of the screen bars is arranged to allow a rotation of the screen bars around their longitudinal axes.

22. The bar screen of claim 15, wherein the screen bars are surface-ground to a value Ra=0.6 to 0.8.

23. The bar screen of claim 15, wherein the screen bars are electro-polished or coated with a low-friction agent.

24. The bar screen of claim 15, further comprising a cleaner for mechanically cleaning the gap.

25. A bar screen for draining liquid from chips in a pulp processor, the bar screen comprising:

a frame and plural screen bars fastened substantially parallel to the frame at their opposite ends in such a manner that a filtering gap is formed between adjacent ones of the screen bars, each of the screen bars having essentially parallel end faces having a length of greater than 0 mm and no more than 40 mm, the end faces being connected by rounded parts; and the gap between the adjacent ones of the screen bars being divided in two adjacent parts, a front part with a narrowing round-edged cone shape and a back part with a widening round-edged cone shape, the back part providing a channel for a flow of extracted liquid.

26. The bar screen of claim 25, wherein the end faces have a length of 20 mm.

* * * * *